United States Patent [19]

Eagles

[11] Patent Number: 4,501,449

[45] Date of Patent: Feb. 26, 1985

[54] FLUID SUPPLY FOR ROTARY CUTTER HEADS FOR MINING MACHINES

[75] Inventor: Brian A. Eagles, Johannesburg, South Africa

[73] Assignee: Coal Industry (Patents) Limited, London, England

[21] Appl. No.: 418,084

[22] Filed: Sep. 14, 1982

[30] Foreign Application Priority Data

Oct. 13, 1981 [GB] United Kingdom ..... 8130807

[51] Int. Cl.[3] ..... E21C 35/22

[52] U.S. Cl. ..... 299/81; 299/12

[58] Field of Search ..... 299/81, 12, 1

[56] References Cited

U.S. PATENT DOCUMENTS

| | | | |
|---|---|---|---|
| 3,904,246 | 9/1975 | Gandy | 299/12 |
| 3,954,302 | 5/1976 | Browning | 299/81 |
| 4,234,008 | 11/1980 | Cronfel | 138/44 |

FOREIGN PATENT DOCUMENTS

| | | | |
|---|---|---|---|
| 2324662 | 12/1973 | Fed. Rep. of Germany | 299/81 |
| 1110763 | 4/1968 | United Kingdom | 299/81 |
| 1206955 | 9/1970 | United Kingdom | 299/12 |
| 1378456 | 12/1974 | United Kingdom | 299/81 |
| 2019920 | 11/1979 | United Kingdom . | |
| 2036830 | 7/1980 | United Kingdom . | |
| 2062725 | 5/1981 | United Kingdom . | |

*Primary Examiner*—Stephen J. Novosad
*Assistant Examiner*—Mark J. DelSignore
*Attorney, Agent, or Firm*—Stevens, Davis, Miller & Mosher

[57] ABSTRACT

A fluid supply system for a rotary cutter head for a mining machine, comprises a relatively low pressure feed arrangement for feeding relatively low pressure fluid to discharge nozzles directing fluid sprays towards the cutting zone of the cutter head, and a relatively high pressure feed arrangement for feeding relatively high pressure fluid to discharge nozzles emitting air flow inducing sprays.

16 Claims, 4 Drawing Figures

FLUID SUPPLY FOR ROTARY CUTTER HEADS FOR MINING MACHINES

This invention relates to fluid supply systems for rotary cutter heads for mining machines.

In particular, although not exclusively, the present invention relates to water feed systems to nozzles mounted on or adjacent to the rotary cutter head.

It is known for a common fluid feed system to supply water to a first set of nozzles mounted adjacent to the outer periphery of the rotary cutter head in order to direct sprays into the cutting zone and to a further set of nozzles mounted adjacent the hub of the cutter head to direct air flow inducing sprays axially of the cutter head. The sprays from the nozzles adjacent to the outer periphery of the cutter head tend to reduce or control dust generated during cutting and the air flow inducing sprays tend to ventilate the cutter head tending to prevent or reduce the build up of methane gas concentration as well as tending to remove the respirable dust extracted from the cutting zone.

Although such a known rotary cutter head tends to operate efficiently as for controlling dust and methane gas concentrations are concerned it was found in practice that when both methods of control were used unacceptably large quantities of water were discharged from the cutter head. The amount of water being so great that excess water was left on the mine floor after the passage of the machine. This excess water frequently tended to unfavourably affect the mining conditions existing on the face causing serious deterioration of the conditions.

An object of the present invention is to provide an improved water feed system for a rotary cutter head or a mining machine which tends to overcome or reduce the above mentioned problem.

According to the present invention, a fluid supply system for a rotary cutter head for a mining machine comprises a relatively low pressure feed arrangement for feeding relatively low pressure fluid to discharge nozzles adapted, in use, to direct fluid sprays towards the cutting zone of the cutter head, and a relatively high pressure feed arrangement for feeding relatively high pressure fluid to discharge nozzles adapted, in use, to emit air flow including sprays.

Preferably, the fluid supply system comprises a relatively high pressure mains feed to the rotary cutter head and a branch line including a pressure reducing device for feeding relatively low pressure fluid from the relatively high pressure mains.

Conveniently, the rotary cutter head is mountable on a shaft of the mining machine, the shaft having an axially extending bore, the fluid supply system comprising a tube arrangement extending along the bore for feeding the relatively high pressure mains feed.

Preferably, a distributor block is hydraulically connected to the tube arrangement.

Conveniently, the pressure reducing device is associated with the distribution block.

Alternatively, the tube arrangement comprises a relatively inner tube extending along the bore and a relatively outer tube extending substantially co-axial with the relatively inner tube, the tubes being associated with the two feed arrangements, respectively.

Preferably, the tubes are hydraulically connected to feed passages, respectively, provided in the distribution block.

Preferably, the feed passage fed from the tube associated with the relatively high pressure feed arrangement feeds an annular channel extending around the distributor block.

Preferably, the discharge nozzles adapted in use to emit air flow inducing sprays are mounted on the distributor block in hydraulic connection with the annular channel.

Preferably, the feed passage fed from the tube associated with the relatively low pressure feed arrangements is adapted to feed a passage extending within the cutter head towards the discharge nozzles adapted in use to direct fluid sprays towards the cutting zone.

The present invention also provides a rotary cutter head comprising a hub assembly drivably mountable on a rotary drive unit of a mining machine, a barrel component secured around, and coaxial with, the hub assembly, air flow inducing means having fluid discharge nozzle means for emitting an air flow inducing spray, further fluid discharge nozzle means for directing a fluid spray towards the cutting zone of the cutter head, and a fluid supply system comprising a relatively low pressure fluid feed arrangement for feeding relatively low pressure fluid to said further fluid discharge nozzle means, and a relatively high pressure feed arrangement for feeding relatively high pressure fluid to the first mentioned fluid discharge nozzle means.

Preferably, the fluid supply system comprises a relatively high pressure mains feed to the rotary cutter head, and a branch line including a pressure reducing device for feeding relatively low pressure fluid from the relatively high pressure mains.

Conveniently, the rotary drive unit comprises a shaft having an axially extending bore, the fluid supply system comprising a tube arrangement extending along the bore for the relatively high pressure mains feed.

Preferably, a distributor block is hydraulically connected to the tube arrangement.

Conveniently, the pressure reducing device is associated with the distributor block.

Alternatively, the fluid supply system comprises a relatively inner tube extending along the axial bore and a relatively outer tube extending substantially co-axial with the relatively inner tube, the tubes being associated with the two feed arrangement, respectively.

Preferably, the tubes are hydraulically connected to feed passages, respectively, provided in the distribution block.

Preferably, the feed passage fed from the tube associated with the relatively high pressure feed arrangement feeds an annular channel extending around the distributor block.

Preferably, the discharge nozzles adapted in use to emit air flow inducing sprays are mounted on the distributor block in hydraulic connection with the annular channel.

Preferably, the feed passage fed from the tube associated with the relatively low pressure fluid feed arrangement is adapted to feed a passage extending within the cutter head towards the discharge nozzles adapted in use to direct fluid sprays towards the cutting zone.

By way of example two embodiments of the present invention will be described with reference to the accompanying drawings in which:-

Figure 2:
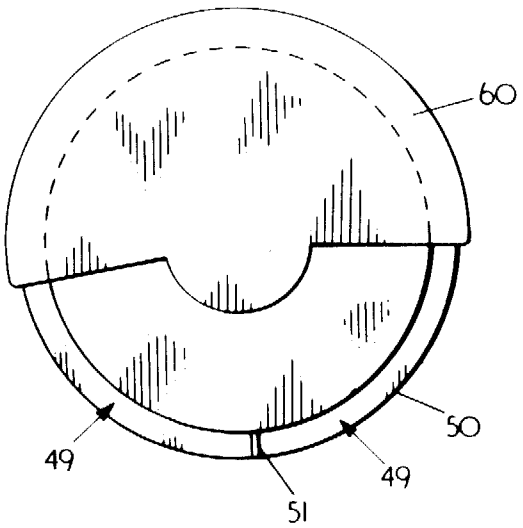
FIG. 2 is an incomplete end view of a detail of FIG. 1.
Figure 1:
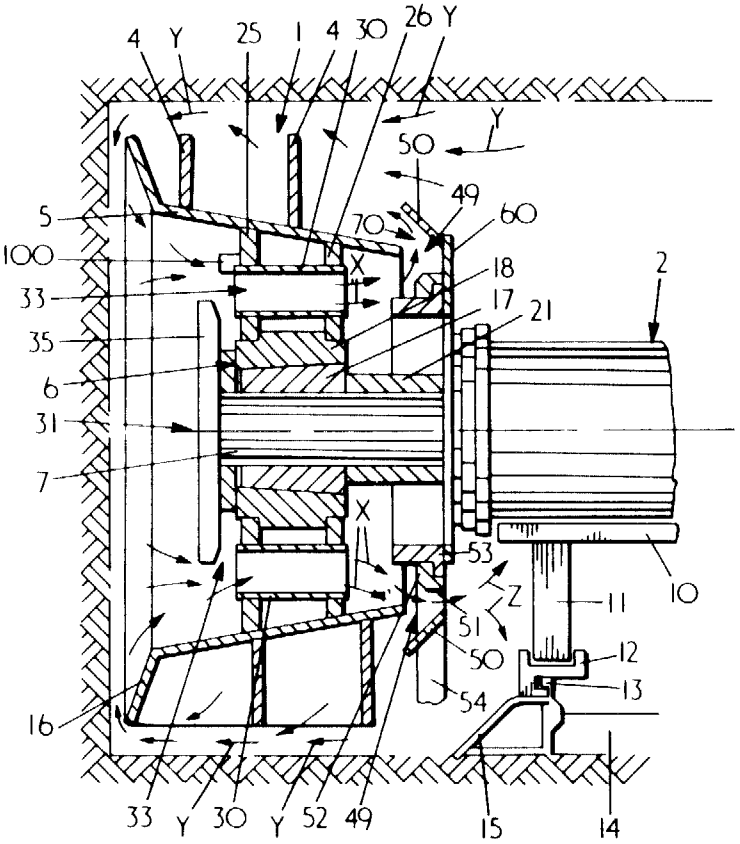
FIG. 1 is an incomplete partly sectional view taken through a rotary cutter head of a mining machine.
Figure 3:
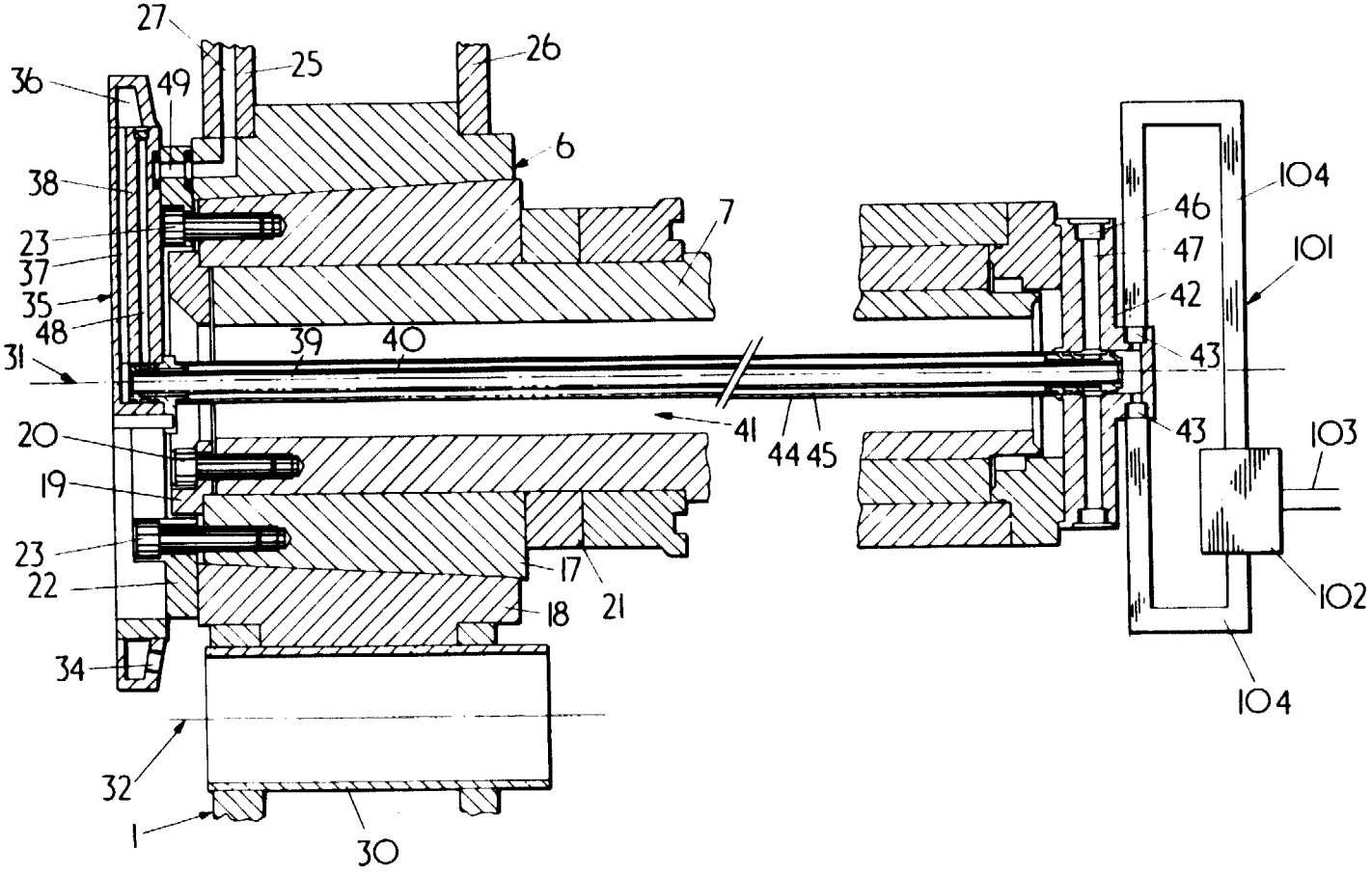
FIG. 3 is an incomplete sectional view taken through a hub portion of the rotary cutter head of FIG. 1 and shown on an enlarged scale.

FIGS. 1 to 3 of the drawings show a rotary cutter head 1 of a well known shearer type coal winning mining machine 2 (only a portion of the cutting section of which is shown) which in use repeatedly traverses to and fro along a longwall face with the rotary cutter head winning coal from the working face. The coal is cut by a plurality of cutter tools (not shown) mounted around the periphery of the cutter head, the cutter tools being mounted in tool holders (not shown) carried on the radially outer extremities of a plurality of cut mineral loading vanes 4 extending helically around and axially along a generally frustro conical barrel component 5 fixedly mounted with respect to a hub assembly 6 drivably mounted on a drive shaft 7 extending from the cutting section of the mining machines. The cutting section may be constituted by a portion of the machine body as indicated in FIG. 1. Alternatively, the cutting section may be constituted by a ranging arm pivotally mounted on the machine body.

As shown in FIG. 1, the machine body is carried on an underframe 10 provided with legs 11 having shoes 12 for slidably engaging elongate rails 13 fixedly mounted on an armoured flexible conveyor 14 extending along the longwall face. The shoe 12 shown in FIG. 1 rests on and is guided by the outer face of the conveyor which also supports a ramp plate 15.

The barrel component 5 also is provided with a generally frustro conical annular back plate 16 forming the working face side of the cutter head 1 and carrying a plurality of tool holders (not shown) for cutting tools (not shown).

The hub assembly 6 which is shown in detail in FIG. 3 comprises a wedge lock bush arrangement 17, 18 for drivably connecting the cutter head to the drive shaft 7. The inner bush element 17 is retained on the shaft by an end retaining plate 19 secured to the shaft by bolts 20 and having a lip overlapping the working face side of the inner bush element, the element being prevented from sliding further along the shaft by spacer members 21.

The relatively outer bush element 18 has a conical wedge surface which co-operates with the conical wedge surface presented by the inner bush element 17. Thus, the outer bush element is drivably connected to the drive shaft via the inner bush element. A further retaining plate 22 secured to the inner bush element by bolts 23 ensures the wedge assembly cannot accidently become disengaged.

The barrel component 5 is fixedly mounted on to the hub assembly 6 by two plates 25, 26 welded to cutouts in the outer bush assembly 18 and to the inwardly directed surface of the barrel component. The plate 25 and outer bush element 18 have passages 27 for feeding dust suppression fluid (i.e. water) to the cutting zone of the cutter head as will be explained later in this specification.

The cutter head 1 comprises ventilating means including a plurality of tubular elements 30 angularly arranged around the rotational axis 31 of the drive shaft and hub assembly, the tubular elements being welded into cut outs provided in the plates 25 and 26 so as to form through passages extending from the working face side of the cutter head to the machine side of the cutter head. In the drawings the axes 32 of the tubular elements are arranged generally parallel to the axis of rotation of the hub assembly. However, in other embodiments the axes of at least some of the tubular elements are inclined relatively to the hub assembly axis. In use, an air flow is induced to flow along the passages of the tubular elements by fluid sprays 33 emitted from nozzle means 34 provided on a distributor block 35 secured to the hub assembly by bolts (not shown), the axis of each spray 33 being inclined to the longitudinal axis of the passage defined by the associated tubular element 30.

The distributor block 35 comprises an annular channel 36 extending around the block to feed pressure fluid to the plurality of nozzles 34, the channel having an input passage 37 extending along a radially extending arm 38. The passage 37 is in hydraulic connection with a passage 39 provided by a rotatably mounted inner tube 40 extending along a through bore 41 formed in the drive shaft 7. The machine side of the rotatable tube 40, (i.e. the end remote from the distributor block) is sealably mounted in an adaptor unit 42 fixedly secured to the cutting section of the machine. Pressurised fluid is fed to the passage 39 via ports 43 and a flexible hose trailing behind the mining machine from a relatively high pressure source (not shown).

An outer tube 44 arranged around the inner tube 50 provides an annular passage 45 connecting feed ports 46 and passages 47 with a passage 48 which is provided in the aforementioned radially extending arm 38 and which hydraulically connects with the aforementioned passage 27 provided in the plate 25 and outer bush element 18 via a short interconnecting passage 49 provided in the retaining plate 22. The feed ports 46 are in hydraulic connection with a source of relatively low pressure fluid via a flexible trailing hose (not shown) arranged to trail behind the mining machine as it traverses along the face, the relatively low pressure fluid being fed along the passages 47, 45, 48, 49 and 27 to spray nozzles (not shown) mounted on the loading vanes adjacent the cutting zone of the cutter head and directed towards the cutting tools. Alternatively, or in addition to the spray nozzles associated with the cutting zone, spray nozzles may be provided on the loading vanes or on the barrel component 5 and arranged to direct sprays along the passages for cut mineral defined by the loading vanes. These spray nozzles which are not shown in the accompanying drawings may be of a type similar to those disclosed in our prior British patent specifications Nos. 1 414 917 and 2 062 725.

The cutter head also includes air flow deflector means comprising an inclined annular guide plate 50 (see FIG. 1 and 2) which is mounted on radially extending arms 51 (only one of which is shown) extending from a support hub 52 to define a plurality elongate apertures 49 effectively extending all around the support hub. The support hub 52 is fixedly mounted on a mounting arrangement 53 for a loading cowl (only a small portion of the arm 54 of which is shown). In use, the loading coal tends to retain cut rock or mineral within the pockets defined by the loading vanes and co-operates with the helical loading vanes to urge cut rock and mineral towards the conveyor 14. In use, the loading cowl is located adjacent to the rear of the cutter head as the mining machine traverses along the longwall face. Thus, when the machine reaches the end of a traverse and reverses its direction of motion it is necessary for the loading cowl to be swung approximately 180° about the axis 31 of the drive shaft in order to be relocated at the opposite side of the cutter head. As the cowl is swung about the axis 31 the inclined deflector guide plate 50 which is fixedly mounted relatively to the cowl also swings about the axis. However, as the apertures 49 provide an effectively continuous opening extending annularly all around the support hub 52 the condition of the opening effectively remain unchanged. A blanking plate 60 fixedly mounted relatively to the cutting section of the mining machine blanks off the apertures 49 associated with the relatively upper region of the deflector guide 50 (see FIGS. 1 and 2). FIG. 1 shows the blanking plate 60 slidably contacting the machine side end of the inclined plate so effectively closing the apertures 49 in the relatively upper region to restrict air flow towards the machine in that region of the cutter head. However, where the blanking plate is not effective (as seen in the relatively lower region of the inclined deflector guide shown in FIG. 1) the apertures 49 are open and air flow towards the machine in this region is permitted. The purpose of this arrangement will be made clear later in the specification.

FIG. 2 illustrates the extent of the area for which the blanking plate 60 is effective. In this particular example the relative upper region of the apertures 49 is closed for approximately 200°.

Such an arrangement ensures that in use when the loading cowl is swung about the axis 31 of the drive shaft, irrespective of the angular position of the cowl, the relative lower region of the apertures 49 is always open to permit air flow from the cutter head towards the machine, the relative upper region of the apertures 49 always remaining closed to air flow towards the mining machine.

In FIG. 1 it can be seen that the inclined deflector guide 50 is located adjacent to the machine side end margin of the barrel component 5 and is arranged to project radially outwardly beyond the adjacent end portion of the barrel component to define an annular aperture 70. The angle of the deflector guide is preferably within the range of 5° to 45° from a line normal to the axis of rotation 31 of the drive shaft. (i.e. as seen in FIG. 1 from 5° to 45° from a substantially vertical plane).

Preferably, the inclined deflector guide 50 is arranged such that the minimum cross-sectional area of the aperture 70 defined between the barrel component and the inclined deflector guide is at least as great as the total minimum cross-sectional area of the passages defined by the tubular element 30.

In use, as the machine is traversing along the longwall face with the cutter head 1 winning rock or mineral from the working face, pressure fluid at a relatively low pressure is fed via ports 46 as previously explained to the spray nozzles provided on the cutter head to suppress dust generated by the cutting tools. Simultaneously, relatively high pressure fluid is supplied to ports 43 and hence via passages 39 and 37 and the channel 36 to the nozzles 34 associated with each of the tubular elements 30 such that air flow inducing sprays are directed along the passages defined by the tubular elements such that air flow within the barrel component 5 is induced to flow along the first path section in a general direction towards the machine side end of the cutter head, as indicated generally by arrows X in FIG. 1. The action of ventilating means 34, 30 also induces air flow along a second path section radially outside the barrel component 5 and in a general direction away from the mining machine side of the cutter head. The air flow along the second path section is indicated generally by arrow Y.

In the relatively upper region of the cutter head the induced air flow flowing along the first path section and in a general direction towards the mining machine side of the cutter head is deflected by the combined effect of the blanking plate 60 and inclined deflection guide 50 such that the air flow flowing along the first path section in this region of the cutter head is urged towards the air flow flowing along the second path section and thereby a preselected portion of the air flow together with some water from the air flow inducing sprays tends to be recirculated within the cutter head.

In the relatively lower region of the cutter head the induced air flow flowing along the first path section and in a general direction towards the mining machine side of the cutter head is permitted to pass through the open apertures 49 to be discharged along a third path section indicated generally by arrows Z from the cutter head into the main ventilation air flow along the longwall face.

The peselected portion of the air flow and associated water from the air flow inducing sprays which is recirculated within the cutter head is determined by the angular extent of the blanking plate 60 and the angle of inclination of the deflection guide 50. It will be appreciated that the greater the angular extent of the blanking plate the greater is the portion of the air flow which is recirculated and vice versa.

The effect of recirculating the air flow tends to reduce the nuisance condition of wet air being discharged into the working zone by the face operators. In addition, the water which is recirculated with the air flow tends to be mixed with the cut material momentarily being conveyed within the pockets defined by the loading vanes 4 and thereby tends to wet the cut material. Thus, as the material is conveyed along the conveyor system including the conveyor 14 there tends to be reduced dust made especially as the wetted material is passed over transfer stations.

Any dust generated within the zone of the cutter head tends to be drawn along the second air flow path section around the working face side of the cutter head and into the air flow passages defined by the tubular elements 30 where it is efficiently wetted by the air flow inducing sprays 33 from the nozzles 34. The wetted dust is carried along the first air flow path section and is either deflected by the deflector means 50, 60 to be mixed with the cut material momentarily within the loading pockets or to be discharged towards the mining machine and conveyor 14 through the open apertures 49 currently within the relative lower region of the cutter head. Dust concentration within the cutting zone also tends to be reduced by the effect of the aforementioned sprays mounted on the loading vanes or on the barrel component.

Any methane produced within the cutting zone tends to be drawn with the induced air flow to be discharged in a diluted state through the same open apertures 49 currently within the relative lower region of the cutter head or recirculated by the plate 60 in the upper region.

The present invention provides an improved cutter head which tends to reduce or control dust concentrations occurring within the cutting zone to an acceptably low level, the amount of water used being maintained within an acceptably low volume. Also, methane concentration in the vicinity of the cutting zone is controlled to within desirable limits.

FIG. 1 shows the cutter head to be provided with a gas and/or air flow sensor 100 arranged to sense a preselected state existing in the vicinity of the cutter head, as for example the concentration of methane existing in the vicinity of the cutter head and to drive a signal indicative of the sensed concentration. The sensor may be mounted on the working face side of the tubular elements 30 (as indicated). Alternatively, or in addition to, one or more sensors may be mounted on the machine side of the tubular elements 30. It is probable that sensors mounted on the working face side of the tubular elements will sense the methane concentration and that sensors mounted on the machine side of the tubular elements will sense air flow conditions, the latter sensor arranged to sense air flow volume and/or pressure. The derived signal is fed along cables (not shown) to processor means (not shown) mounted either on the mining machine or on a control panel mounted at the end of the working face remote from the machine. The processor means is arranged to receive the derived signal and to switch off the power supply to the mining machine should the sensed gas concentration reach or approach a preselected critical value. Alternatively, or in addition to, the processor means activates an alarm should the sensed gas concentration reach or approach a preselected critical value.

An air flow sensor would be arranged to sense the flow rate of the air flow and would be adapted to derive a signal indicative of the sensed flow rate. The sensor may sense the flow rate by detecting the pressure of the air flow and in which case the sensor would be adapted to derive a signal indicative of the sensed pressure.

Turning now to FIG. 3, adjacent the right hand side of the drawing is indicated a fluid flow sensor arrangement 101 which is built into the relatively high pressure water supply to the nozzles 34 in the distributor block 35 and which is adapted to sense a preselected operational condition of the water supply to the nozzles 34. The arrangement comprises a fluid flow and/or fluid pressure sensor unit 102 fed with relatively high pressure water through a connector pipe 103 which in turn is connected to the aforementioned relatively high pressure source via a flexible trailing hose. The output of the flow sensor unit 102 is connected via connectors 104 to the inlet ports 43 of the previously described relatively high pressure water system within the cutter head.

The sensor unit 102 is adapted to sense the flow of water to the relatively high pressure system and to derive a signal indicative of the flow. The derived signal is fed to a processor unit (not shown) arranged to receive the signal and to de-activate the machine by switching off the power supply to the mining machine should the sensed flow fall below a preselected volume. Alternatively or in addition to the flow sensor the sensor unit may include a fluid pressure sensor arranged to sense the fluid pressure supply and to derive a signal of pressure supply. The signal de-activating the machine if the pressure reaches a preselected critical value. Thus in operation should any one of the nozzles 34 become blocked or inoperative for any reason the flow sensor unit 102 senses the resultant reduction in water flow, the derived signal is carried accordingly and the processor means actuates control means to switch off the machine. Such an arrangement tends to ensure that if any of the nozzles 34 does become blocked or inoperative such that no air flow inducing spray is directed along the passage of the associated tubular element 30, then the machine is halted. Such an arrangement may be considered necessary when working in conditions where no recirculation of air flow within the barrel component can be tolerated or where only a preselected amount of recirculation can be tolerated. It will be understood that should any one of the sprays become blocked or inoperative then an air flow might be urged to flow along the passage of the associated tubular element in a reverse direction, i.e. away from the mining machine side of the cutter head and towards the working face side of the cutter head. Thus, recirculation of air flow would tend to take place within the barrel component and a resultant excessive build up in methane concentration within the cutting zone could occur. However, by providing the flow sensor arrangement including the unit 102 such a potentially dangerous condition would tend to be avoided.

In other embodiments the unit 102 is adapted to activate an alarm if the water flow falls below a preselected volume.

Figure 4:
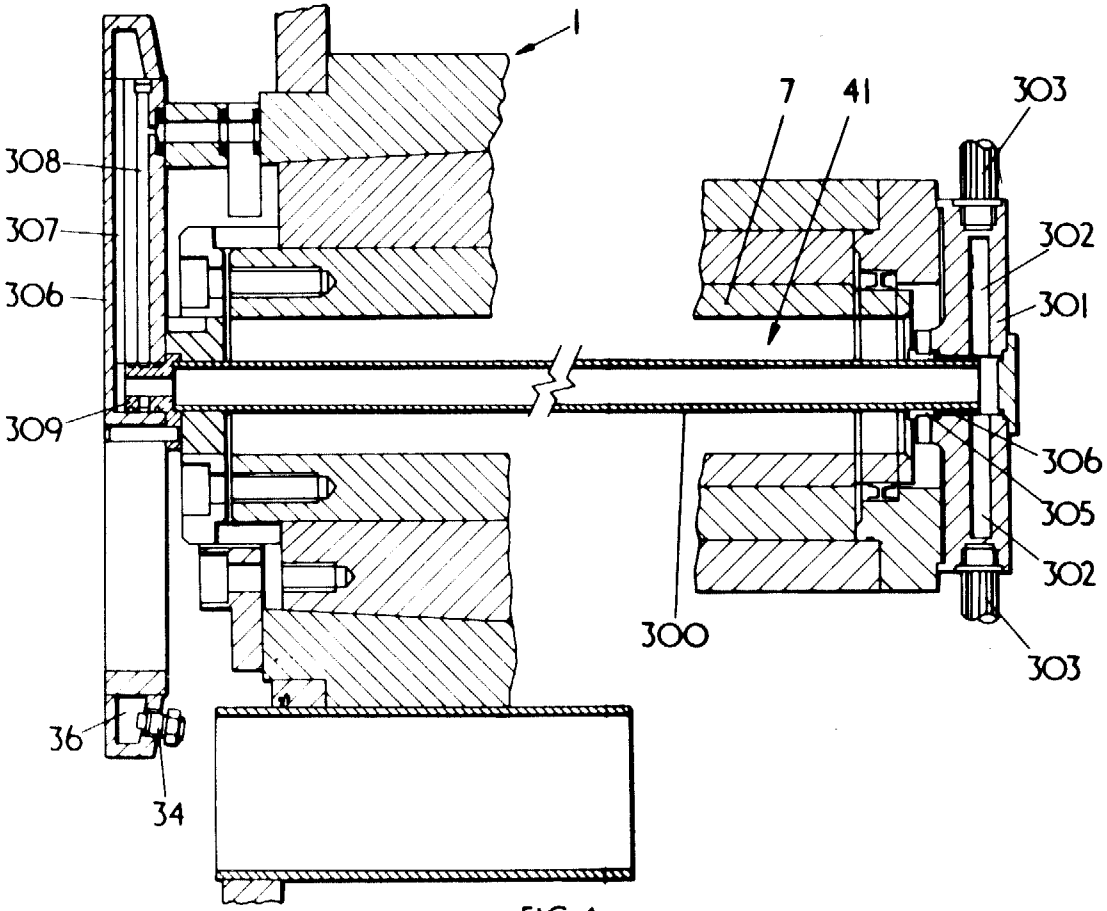
FIG. 4 is an incomplete sectional view similar to FIG. 3 but showing a second embodiment of the present invention.

Referring now to FIG. 4 which shows a second embodiment of the present invention, the tube arrangement extending axially along the bore 41 provided in the shaft 7 comprises a signle tube 300 sealably engaged in an adaptor unit 301 mounted on the side of the machine body and provided with passages 302 for feeding relatively high pressure fluid from a relatively high pressure mains feed 303. The adaptor unit 301 comprises a fluid seal 304 and bearing 305 for engaging the tube 300 which in use rotates with the rotary cutter head 1.

A distributor block 306 mounted within the cutter head is hydraulically connected to the end of the tube 300 remote from the adaptor unit 301. The distributor block provides passages 307 for feeding relatively high pressure fluid to the nozzles 34 associated with the annular channel 36 extending around the block. The distributor block 306 also provides passages 398 (only one of which is shown) for relatively low pressure fluid to the spray nozzles for directing fluid sprays towards the cutting zone of the cutter head. The passages 308 constitute branch lines from the main relatively high pressure feed, a pressure reducing device 309 being provided in the branch line. In FIG. 4 the pressure reducing device is shown mounted axially with the tube 300. In other embodiments the pressure reducing device is mounted elsewhere on the distribution block radially displaced from the axis of rotation.

I claim:

1. A fluid supply system for a rotary cutter head mounted on a rotary drive shaft of a mining machine, comprising an adaptor unit mounted on the mining machine, the adaptor unit defining inlet means for a relatively low pressure feed arrangement and further inlet means for a relatively high pressure feed arrangement, means defining separate passage means for feeding the relatively low pressure feed and the relatively high pressure feed from the inlet means and the further inlet means along the rotary drive shaft, distributor means mounted within the rotary cutter head for rotation therewith and defining first distributing passage means for feeding the relatively low pressure fluid from said separate passage means to first discharge nozzles positioned to direct fluid sprays towards the cutting zone of the cutter head, the distributor means further defining second distributing passage means for feeding relatively high pressure fluid from said separate passage means to second discharge nozzles positioned to emit air flow inducing sprays.

2. A system as claimed in claim 1 in which the shaft has an axially extending bore, and the fluid supply system comprises a tube arrangement extending along the bore for feeding the relatively high pressure mains feed.

3. A system as claimed in claim 2, in which a distributor block is hydraulically connected to the tube arrangement.

4. A system as claimed in claim 3, in which the tube arrangement comprises a relatively outer tube extending along the bore and a relatively inner tube extending substantially co-axial with the relatively outer tube, the tubes being associated with the two feed arrangements, respectively.

5. A system as claimed in claim 4, in which the tubes are hydraulically connected to feed passages, respectively, provided in a distribution block.

6. A system as claimed in claim 1 in which the relatively high pressure feed arrangement comprises an annular channel extending around the distributor block.

7. A system as claimed in claim 6, in which the second discharge nozzles connected in use to emit air flow inducing sprays are mounted on the distributor block in hydraulic connection with the annular channel.

8. A system as claimed in claim 1 which the relatively low pressure feed arrangement is connected to feed a passage extending within the cutter head towards the first discharge nozzles.

9. A rotary cutter head mounted on a rotary drive shaft of a mining machine, comprising a hub assembly drivably mounted on the rotary drive shaft, a barrel component secured around and coaxial with the hub assembly; first fluid discharge nozzle means for directing a fluid spray towards a cutting zone of the cutter head, air flow inducing means having second fluid discharge nozzle means for emitting an air flow inducing spray, and a fluid supply system comprising an adaptor unit mounted on the mining machine, the adaptor unit defining inlet means for a relatively low pressure feed arrangement and further inlet means for a relatively high pressure feed arrangement, means defining separate passage means for feeding the relatively low pressure feed and the relatively high pressure feed from the inlet means and the further inlet means along the rotary drive shaft, distributor means mounted within the barrel component for rotation therewith and defining first distributing passage means for feeding the relatively low pressure fluid from said separate passage means to said first fluid discharge nozzle means, the distributor means further defining second distributing passage means for feeding relatively high pressure fluid from said separate passage means to said second fluid discharge nozzle means.

10. A rotary cutter head as claimed in claim 9, comprising a shaft having an axially extending bore, the fluid supply system comprising a tube arrangement extending along the bore for the relatively high pressure mains feed.

11. A rotary cutter head as claimed in claim 10, in which a distributor block is hydraulically connected to the tube arrangement.

12. A rotary cutter head as claimed in claim 10, in which the tube arrangement comprises a relatively inner tube extending along the axial bore and a relatively outer tube extending substantially coaxial with the relatively inner tube, the tubes being connected to the two feed arrangements, respectively.

13. A rotary cutter head as claimed in claim 12, in which the tubes are hydraulically connected to feed passages, respectively, provided in a distributor block.

14. A rotary cutter head as claimed in claim 10 in which the relatively high pressure feed arrangement feeds an annular channel extending around the distributor block.

15. A rotary cutter head as claimed in claim 14, in which the second discharge nozzles are mounted on the distributor block in hydraulic connection with the annular channel.

16. A rotary cutter head as claimed in claim 9 in which the relatively low pressure fluid feed arrangement is adapted to feed a passage extending within the cutter head towards the first discharge nozzles.

* * * * *